United States Patent [19]

Voorhees

[11] Patent Number: 4,979,085

[45] Date of Patent: Dec. 18, 1990

[54] LIGHT DISPLAY APPARATUS

[76] Inventor: Austin B. Voorhees, 104 Wellington St., Hickman, Ky. 42050

[21] Appl. No.: 498,683

[22] Filed: Mar. 26, 1990

[51] Int. Cl.[5] ..... F21P 1/00

[52] U.S. Cl. ..... 362/252; 362/311; 362/351; 211/196; 248/158

[58] Field of Search ..... 362/351, 361, 249, 252, 362/311, 410; 248/158, 159; 211/196

[56] References Cited

U.S. PATENT DOCUMENTS

| | | | |
|---|---|---|---|
| 3,176,123 | 3/1965 | Blake | 362/410 |
| 3,338,605 | 8/1967 | Stoeber | 248/159 |
| 3,677,867 | 7/1972 | Westlund | 362/249 |
| 3,704,366 | 11/1972 | Korb et al. | 240/10 T |
| 4,079,241 | 3/1978 | Marchio | 362/410 |
| 4,404,621 | 9/1983 | Mauro | 362/419 |
| 4,620,270 | 10/1986 | Laakso | 362/123 |

*Primary Examiner*—Carroll B. Dority
*Attorney, Agent, or Firm*—Walker & McKenzie

[57] ABSTRACT

An apparatus for displaying lights. The apparatus includes an elongated body having a first end and a second end; and a base for being mounted on the second end of the body; the base includes a center member, an outer member, and joining structure extending between the center member and the outer member for fixedly joining the center member to the outer member.

15 Claims, 3 Drawing Sheets

LIGHT DISPLAY APPARATUS

BACKGROUND OF THE INVENTION

1. Field of the Invention

The present invention relates, in general, to a light display apparatus and, more specifically, to an apparatus for allowing lights to be displayed for Christmas and other festive occasions.

2. Information Disclosure Statement

A preliminary patentability search conducted in class 362, subclasses 123 and 806 produced the following U.S. Pat. Nos.: Korb et al., 3,704,366; Mauro, 4,404,621; and Laakso, 4,620,270. Korb et al., U.S. Pat. No. 3,704,366 discloses an artificial Christmas tree including a vertical main tubular trunk, an annular hub member secured to the lower end of the trunk, a plurality of tubular branch members radially extending from the hub member, an electrical junction box provided at the upper end of the trunk, a plurality of electrical wires extending downwardly and outwardly from the junction box to the branch members, each wire having a plurality of spaced apart lights thereon, a plurality of leg support members extending downwardly and outwardly from the hub member, and means attached to the terminal end of each leg for securing the structure to a base member or to the surface of the ground. Mauro, U.S. Pat. No. 4,404,621 discloses a device for mounting decorative lights or the like to a natural tree or the like, the device including a crown for being positioned at the top of the tree, a plurality of elongated tracks pivotally attached to the crown, a pulley associated with each track, and guide means slidably mounted in each track for allowing a string of lights or the like to be secured in each track and raised or lowered in the tracks. Laakso, U.S. Pat. No. 4,620,270 discloses a simulated Christmas tree including a ring shaped base member, means for releasably securing the base member to a support surface, an elongated post having a pointed lower end for being implanted in the ground substantially at the center of the base member and having an upper end positioned a spaced distance above the base member, and a plurality of strings of lights extending between the upper end of the post and the base member to give the appearance of a decoratively lit Christmas tree.

None of the above patents disclose or suggest the present invention. More specifically, none of the above patents disclose or suggest a light display apparatus including an elongated body means having a first end and a second end; and base means for being mounted on the second end of the body means; the base means including a center member, an outer member, and joining means extending between the center member and the outer member for fixedly joining the center member to the outer member.

SUMMARY OF THE INVENTION

The light display apparatus of the present invention includes an elongated body means having a first end and a second end; and base means for being mounted on the second end of the body means; the base means including a center member, an outer member, and joining means extending between the center member and the outer member for fixedly joining the center member to the outer member.

One objective of the present invention is to provide a light display apparatus for displaying Christmas lights in a Christmas tree-type manner.

Another objective of the present invention is to provide a light display apparatus that is simple and inexpensive to manufacture.

Another objective of the present invention is to provide a light display apparatus that can be easily dismantled for storage.

DESCRIPTION OF THE PREFERRED EMBODIMENT

Figure 1:
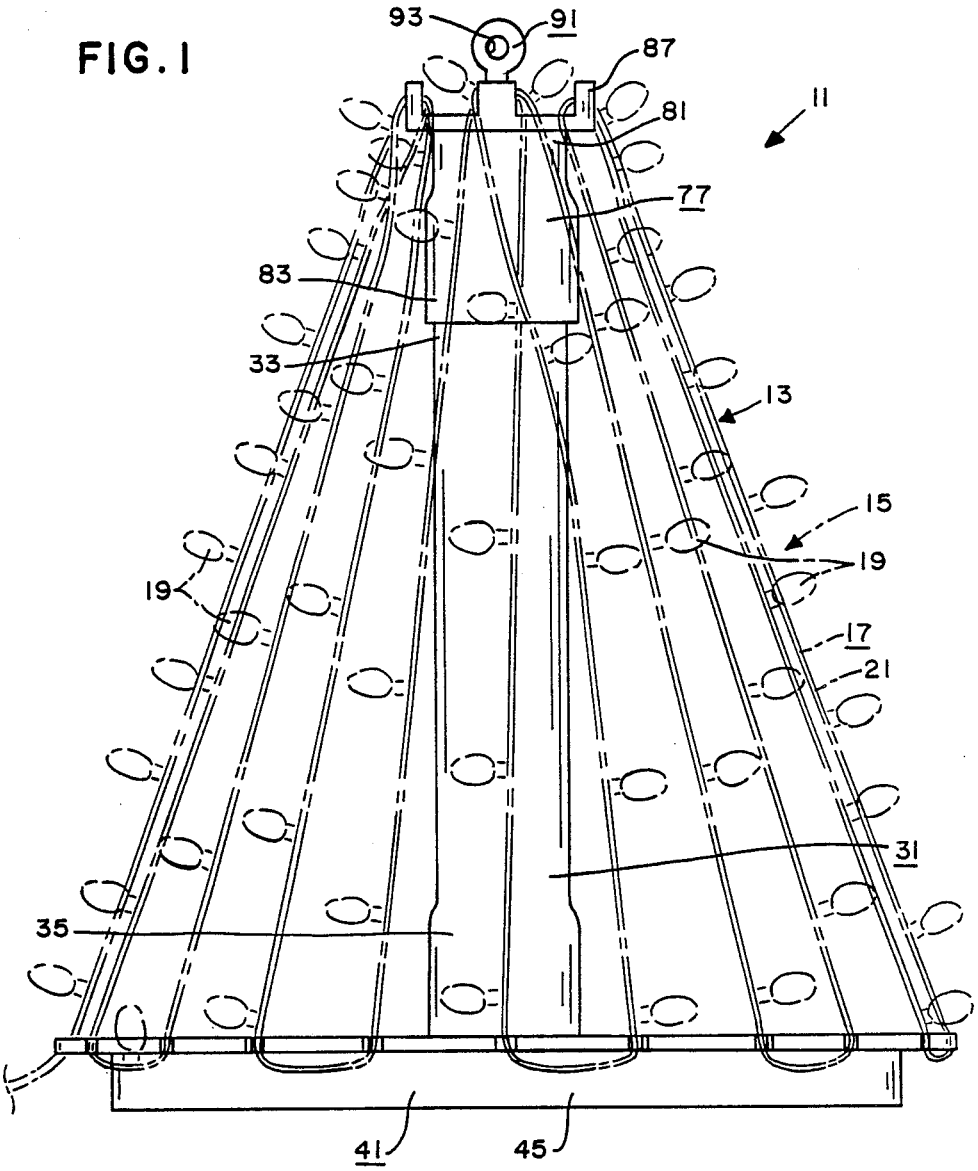
FIG. 1 is a front elevation view of the light display apparatus of the present invention shown in combination with an elongated, flexible strand of Christmas lights.
Figure 2:
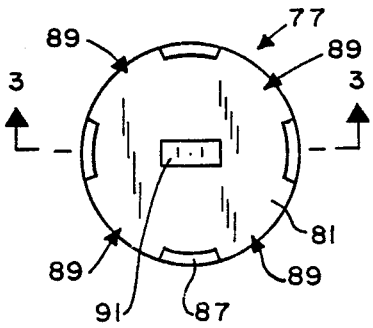
FIG. 2 is a top plan view of a cap means of the light display apparatus of the present invention.
Figure 3:
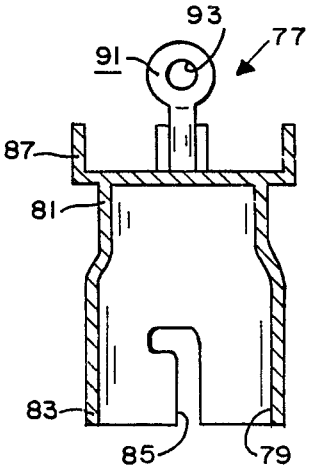
FIG. 3 is a sectional view substantially as taken on line 3—3 of FIG. 2.
Figure 4:
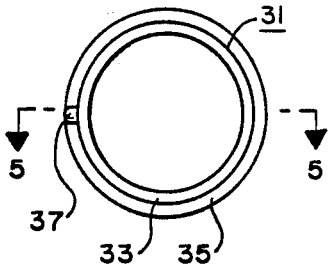
FIG. 4 is a top plan view of a body means of the light display apparatus of the present invention.

The preferred embodiment of the apparatus 11 of the present invention is for use as a Christmas decoration and can be used to provide the appearance of a decorative Christmas tree.

The apparatus 11 includes a framework 13 for supporting light means 15. The light means 15 may consist of a conventional elongated, flexible strand 17 of Christmas lights as clearly shown in FIG. 1. As will now be apparent to those skilled in the art, the strand 17 of Christmas lights includes a plurality of light bulbs 19 electrically joined to one another and to a source of electrical energy by a flexible electric cable 21. On the other hand, the light means 15 may consist of one or more conventional lamp means 23 as clearly shown in FIG. 11. Thus, each lamp means 23 typically includes a lamp socket 25, a light bulb 27 for being screwed into the lamp socket 25, and an electric cable 29 for electrically joining the lamp socket 25 to a source of electrical energy.

Figure 5:
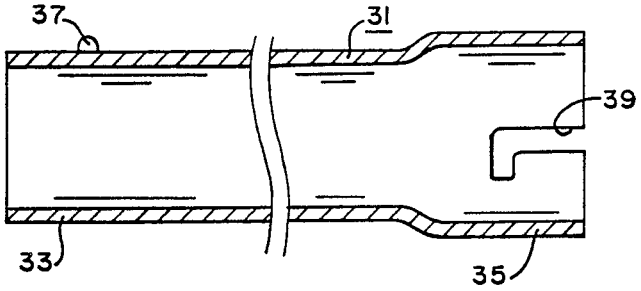
FIG. 5 is a sectional view substantially as taken on line 5—5 of FIG. 4.
Figure 6:
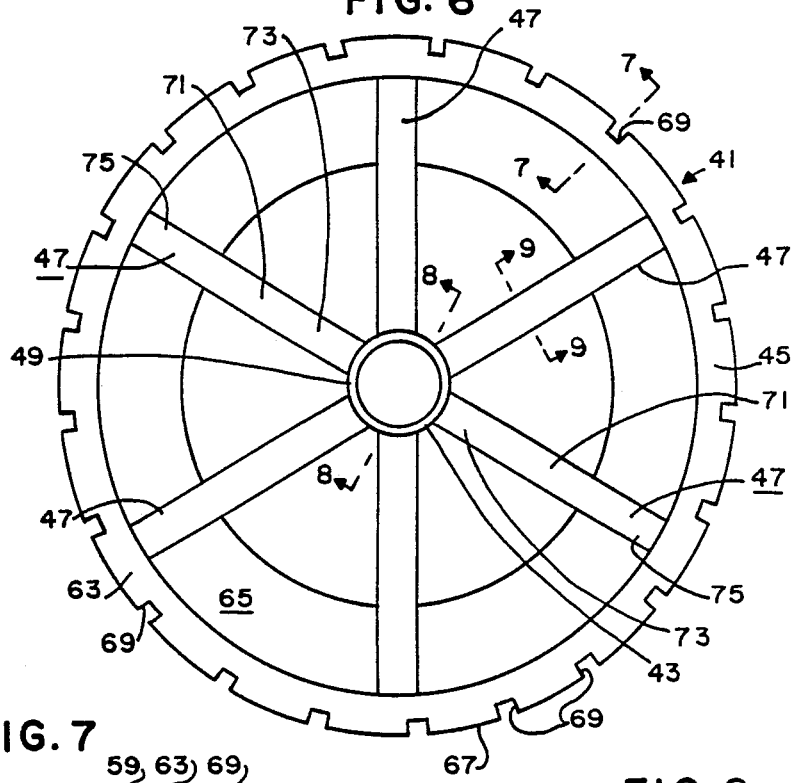
FIG. 6 is a reduced top plan view of a base means of the light display apparatus of the present invention.
Figure 7:
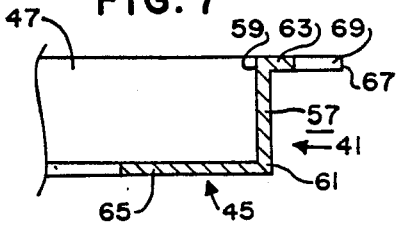
FIG. 7 is an enlarged sectional view substantially as taken on line 7—7 of FIG. 6.
Figure 8:
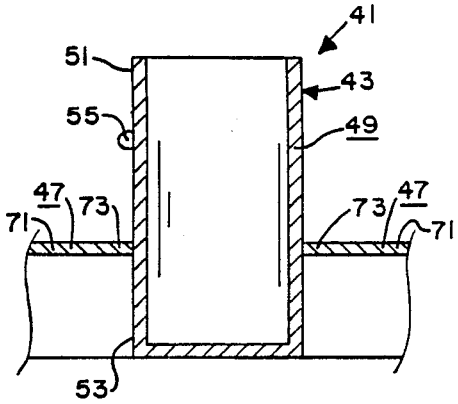
FIG. 8 is an enlarged sectional view substantially as taken on line 8—8 of FIG. 6.

The framework 13 includes an elongated body means 31 having a first or normally upper end 33 and a second or normally lower end 35. The body means 31 preferably consists of an elongated, hollow polyvinyl chloride (PVC) pipe or the like having an outwardly extending peg or boss 37 adjacent the first end 33 thereof and a J-shaped slot 39 extending from the second end 35 thereof as clearly shown in FIG. 5 for reasons which will hereinafter become apparent. The second end 35 of the body means 31 is preferably enlarged as compared to the first end 33 thereof for reasons which will hereinafter become apparent. The framework 13 may include a plurality of identical body means 31 for being joined end-to-end to thereby increase the height of the framework 13 as will now be apparent to those skilled in the art. More specifically, the first end 33 of a first body means 31 can be inserted into the enlarged second end 35 of a second body means 31 with the peg 37 of the first body means 31 extending into the slot 39 of the second body means 31 to attach the first and second body means 31 to one another and to double the height of the framework 13 as will now be apparent to those skilled in the art.

The framework 13 includes base means 41 for being mounted on the second end 33 of the body means 31 (or the second end 33 of the lowermost body means 31). The base means 41 includes a center member 43, an outer member 45, and joining means 47 extending between the center member 43 and the outer member 45 for joining the center member 43 and outer member 45 to one another.

The center member 43 of the base means 41 preferably includes a post member 49 having a first or upper end 51 and a second or lower end 53. The first end 51 of the post member 49 is preferably the same shape and size so as to fit into the second end 35 of any body means 31. The post member 49 preferably includes a peg or boss 55 adjacent the first end 51 thereof for extending into the slot 39 in the second end 35 of the body means 31, etc., as will now be apparent to those skilled in the art. Thus, the first end 51 of the post member 49 may be identical in size and shape to the first end 33 of the body means 31.

The apparatus 11 preferably includes attachment means for attaching the second end 35 of the body means 31 and the first end 51 of the post member 49 to one another. This attachment means may be defined by the slot 39 in the second end 35 of the body means 31 and the peg 55 adjacent the first end 51 of the post member 49 as will now be apparent to those skilled in the art.

The outer member 45 of the base means 41 is preferably circular in shape. More specifically, the outer member 45 preferably includes a ring member 57 having a diameter that is proportional to the expected maximum height of the apparatus 11 to provide a stable support for the apparatus 11. Thus, the ring member 57 preferably has a diameter equal to the expected maximum height of the apparatus 11. The ring member 57 preferably consists of a substantially flat band having a first or upper edge 59 and a second or lower edge 61. The outer member 45 preferably includes an outwardly extending flange 63 attached to the first edge 59 of the ring member 57 and an inwardly extending flange 65 attached to the second edge 61 of the ring member 57. The outwardly extending flange 63 preferably includes an outer edge 67 having a plurality of spaced apart notches 69 therein.

Figure 9:
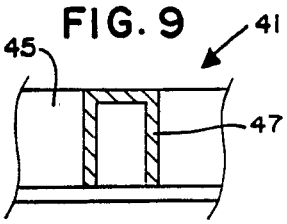
FIG. 9 is an enlarged sectional view substantially as taken on line 9—9 of FIG. 6.
Figure 10:
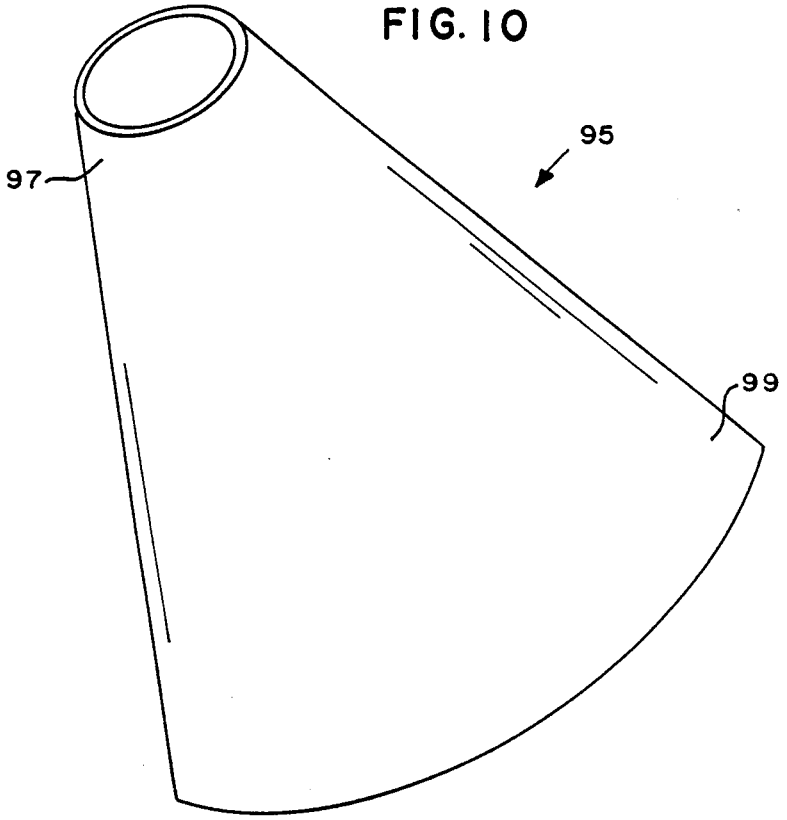
FIG. 10 is a perspective view of a hollow, conical shade member of the light display apparatus of the present invention.

The joining means 47 of the base means 41 preferably includes a plurality of spoke members 71 extending radially between the center member 43 and the outer member 45. Each spoke member 71 preferably has a first or inner end 73 fixedly attached to the post member 49 of the center means 43 and a second or outer end 75 fixedly attached to the ring member 57 of the outer member 45. Each spoke member 71 may have a cross-sectional shape on an inverted U as clearly shown in FIG. 9.

The base means 41 may be constructed in various manners and out of various materials as will now be apparent to those skilled in the art. Thus, the base means 41 may be molded or otherwise constructed out of polyvinyl chloride plastic or the like.

The framework 13 preferably includes cap means 77 for being mounted on the first end 33 of the body means 31. The cap means 77 preferably has a cavity 79 for receiving the first end 33 of the body means 31. More specifically, the cap means 77 preferably includes a hollow pipe having a first or upper end 81 and a second or lower end 83. The second end 83 is preferably shaped and sized so as to fit into the first end 33 of the body means 31. The cap means 77 preferably has a J-shaped slot 85 extending from the second end 83 thereof for receiving the peg 37 of the body means 31 as will now be apparent to those skilled in the art. Thus, the second end 83 may be identical in size and shape as the second end 35 of the body means 31. The first end 81 is preferably closed and the cap means 77 preferably includes an upwardly directed flange 87 on the closed first end 81. The flange 87 preferably has a plurality of spaced notches 89 therein for reasons which will hereinafter become apparent. Thus, with the notches 89, the flange 87 may be considered to be a plurality of spaced tabs extending upward from the closed first end 81. The cap means 77 preferably includes a central boss member 91 extending upward from the closed first end 81. The boss member 91 preferably has a transverse aperture 93 through the distal end thereof for allowing the apparatus 11 to be hung from an overhead support or the like in any manner now apparent to those skilled in the art such as, for example, by a length of rope extending through the aperture 93 and fixed to the overhead support. The cap means 77 may be constructed in various manners and out of various materials as will now be apparent to those skilled in the art. Thus, the cap means 77 may be molded or otherwise constructed out of polyvinyl chloride plastic or the like.

The apparatus 11 preferably includes attachment means for attaching the first end 33 of the body means 31 and the cap means 77 to one another. This attachment means may be defined by the slot 85 in the second end 83 of the cap means 77 and the peg 37 adjacent the first end 33 of the body means 31 as will now be apparent to those skilled in the art.

Figure 11:
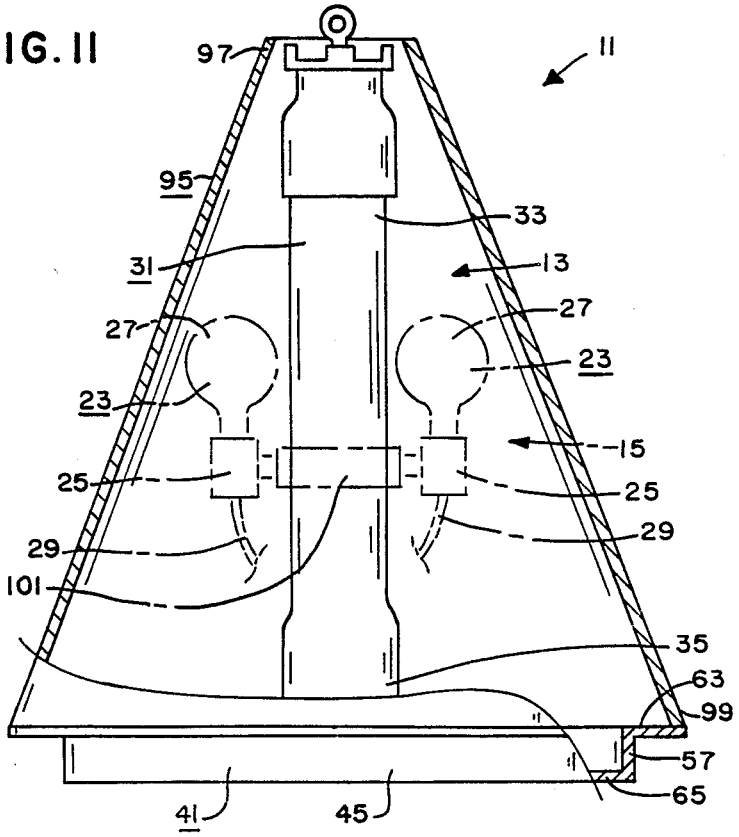
FIG. 11 is a front elevational view of the light display apparatus of the present invention shown in combination with a pair of light members and with portions thereof broken away for clarity.

The apparatus 11 preferably includes a hollow, conical translucent shade member 95 for covering the body means 31 as clearly shown in FIG. 11. The shade member 95 preferably has a first or upper edge 97 and a second or lower edge 99. The lower edge 99 is preferably sized so as to rest on the outer edge 67 of the flange 63 of the outer member 45 of the base means 41 as shown in FIG. 11. The shade member 95 may be constructed in a manner and out of material similar to that of an ordinary lamp shade or the like as will now be apparent to those skilled in the art.

The operation and use of the apparatus 11 of the present invention is quite simple. Since the body means 31, base means 41 and cap means 77 can be detached from one another to allow the apparatus 11 to be compactly stored, the first step in using the apparatus 11 is normally to insert the first end 33 of the body means 31 into the cavity 79 of the cap means 77, and insert the first end 51 of the post member 49 into the second end 35 of the body means 31. As will now be apparent to those skilled in the art, a twist of the cap means 77 on the body means 31 will cause the peg 37 of the body means 31 to be looked within the J-shaped slot 85 of the cap means 77, and, likewise, a twist of the body means 31 on the base means 41 will cause the peg 55 of the base means 41 to be locked within the J-shaped slot 39 of the body means 31. Next, to display the strand 17 of Christmas lights as shown in FIG. 1, the electric cable 21 is merely looped about the notches 69 of the base means 41 and the notches 89 of the cap means 77 to cause light bulbs 19 to be positioned between the cap means 77 and base means 41. However, to display the lamp means 23 as shown in FIG. 11, one or more lamp sockets 25 are fixedly attached to the body means 31 preferably about midway between the first and second ends 33, 35 of the body means 31 by way of a bracket 101 or the like. The shade member 95 can then be placed over the body means 31 as shown in FIG. 11.

Although the present invention has been described and illustrated with respect to a preferred embodiment and a preferred use therefor, it is not to be so limited since modifications and changes can be made therein which are within the full intended scope of the invention.

I claim:

1. An apparatus for displaying an elongated, flexible strand of lights, said apparatus comprising, in combination:

(a) an elongated body means having a first end and a second end; and (b) base means for being mounted on said second end of said body means; said base means including a center member, an outer member, and joining means extending between said center member and said outer member for fixedly joining said center member to said outer member, said outer member of said base means including a ring member for allowing said strand of lights to be looped between said first end of said body means and said ring member.

2. An apparatus for displaying light means, said apparatus comprising, in combination:

(a) an elongated body means having a first end and a second end; and (b) base means for being mounted on said second end of said body means; said base means including a center member, an outer member, and joining means extending between said center member and said outer member for fixedly joining said center member to said outer member, said outer member of said base means including a ring member having first and second edges, and said outer member including an outwardly extending flange attached to said first edge of said ring member.

3. The apparatus of claim 2 in which said outer member of said base means includes an inwardly extending flange attached to said second edge of said ring member.

4. The apparatus of claim 3 in which said joining means of said base means includes a plurality of spoke members extending radially between said center member and said outer member.

5. The apparatus of claim 4 in which said spoke members of said joining means of said base means are fixedly attached to said center member and said outer member.

6. The apparatus of claim 5 in which said outwardly extending flange of said outer member of said base means includes an outer edge having a plurality of spaced apart notches therein.

7. The apparatus of claim 6 in which said center member of said base means includes a post member having a first end and a second end; and in which said second end of said body means has a cavity for receiving said first end of said post member of said center member of said base means.

8. The apparatus of claim 7 in which is included attachment means for attaching said second end of said body means and said first end of said post member of said center member of said base means to one another.

9. The apparatus of claim 8 in which is included cap means for being mounted on said first end of said body means, said cap means having a cavity for receiving said first end of said body means.

10. The apparatus of claim 9 in which is included attachment means for attaching said first end of said body means and said cap means to one another.

11. The apparatus of claim 1 in which said cap means includes an upwardly directed flange having a plurality of spaced notches therein.

12. The apparatus of claim 11 in which said cap means includes a central boss member having a transverse aperture therethrough.

13. The apparatus of claim 1 in which is included a hollow, conical shade member for fitting over said body means.

14. An apparatus for displaying an elongated, flexible strand of Christmas lights, said apparatus comprising, in combination:

(a) an elongated body means having a first end and a second end;

(b) cap means for being attached to said first end of said body means; said cap means having a plurality of spaced notches therein; and (c) base means for being attached to said second end of said body means; said base means including a center member, an outer member, and joining means extending between said center member and said outer member for fixedly joining said center member to said outer member, said outer member of said base means having a plurality of spaced notches therein, said strand of Christmas lights being looped between said cap means and said outer member of said base means through said notches in said cap means and said outer member of said base means.

15. An apparatus for displaying a light member, said apparatus comprising, in combination:

(a) an elongated body means having a first end and a second end; said light member being coupled to said body means;

(b) cap means for being attached to said first end of said body means;

(c) base means for being attached to said second end of said body means; said base means including a center member, an outer member, and joining means extending between said center member and said outer member for fixedly joining said center member to said outer member; said outer member of said base means including a ring member; and (d) a hollow, conical shade member for fitting over said body means and said light member, said shade member having a lower edge for resting on said ring member of said outer member of said base means.

* * * * *